US010563890B2

(12) United States Patent
Sharma

(10) Patent No.: US 10,563,890 B2
(45) Date of Patent: Feb. 18, 2020

(54) MODULATOR FOR SUB-COOL CONDENSER

(71) Applicants: DENSO International America, Inc., Southfield, MI (US); DENSO CORPORATION, Kariya-shi, Aichi-ken (JP)

(72) Inventor: Rajeev Sharma, Troy, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 195 days.

(21) Appl. No.: 15/606,858

(22) Filed: May 26, 2017

(65) Prior Publication Data

US 2018/0340718 A1 Nov. 29, 2018

(51) Int. Cl.

| | |
|---|---|
| ***F25B 39/04*** | (2006.01) |
| ***F28D 7/10*** | (2006.01) |
| ***F25B 40/02*** | (2006.01) |
| ***F28F 1/16*** | (2006.01) |
| ***F28F 21/08*** | (2006.01) |
| ***F28D 1/04*** | (2006.01) |
| ***F28D 1/053*** | (2006.01) |
| ***F28D 7/00*** | (2006.01) |
| *F28D 21/00* | (2006.01) |

(52) U.S. Cl.

CPC ..... *F25B 39/04* (2013.01); *F25B 40/02* (2013.01); *F28D 1/0461* (2013.01); *F28D 1/05391* (2013.01); *F28D 7/0041* (2013.01); *F28D 7/10* (2013.01); *F28F 1/16* (2013.01); *F28F 21/084* (2013.01); *F25B 2339/044* (2013.01); *F25B 2339/0441* (2013.01); *F25B 2400/23* (2013.01); *F28D 2021/007* (2013.01); *F28F 2255/16* (2013.01)

(58) Field of Classification Search

CPC .... F25B 39/04; F25B 40/02; F25B 2339/044; F25B 2339/0441; F25B 2339/0444; F25B 2339/0446; F25B 2400/16; F25B 2400/23; F28D 1/0461; F28D 1/05391; F28D 7/0041; F28D 2021/007; F28F 2009/0292

See application file for complete search history.

(56) References Cited

U.S. PATENT DOCUMENTS

| | | | | |
|---|---|---|---|---|
| 3,898,867 | A | 8/1975 | Andersson et al. | |
| 5,009,262 | A | 4/1991 | Halstead et al. | |
| 5,228,315 | A * | 7/1993 | Nagasaka | F25B 39/04 165/110 |
| 6,374,632 | B1 | 4/2002 | Nobuta et al. | |
| 6,397,627 | B1 | 6/2002 | Aki et al. | |
| 6,698,235 | B2 | 3/2004 | Nobuta et al. | |
| 6,889,521 | B2 | 5/2005 | Seno et al. | |

(Continued)

FOREIGN PATENT DOCUMENTS

| | | |
|---|---|---|
| JP | 5050857 B2 | 10/2012 |
| WO | WO-2004061377 A1 | 7/2004 |
| WO | WO-2007074796 A1 | 7/2007 |

*Primary Examiner* — Eric S Ruppert
*Assistant Examiner* — Hans R Weiland
(74) *Attorney, Agent, or Firm* — Harness, Dickey & Pierce, P.L.C.

(57) ABSTRACT

A modulator for a sub-cool condenser assembly including a condenser. The modulator includes a plurality of extruded tubes positioned to convey liquid refrigerant towards an outlet of the modulator.

11 Claims, 3 Drawing Sheets

(56) References Cited

U.S. PATENT DOCUMENTS

| | | | | |
|---|---|---|---|---|
| 6,904,770 | B2 | 6/2005 | Telesz et al. | |
| 7,093,461 | B2 * | 8/2006 | Patel | F25B 39/04 62/509 |
| 7,165,417 | B2 * | 1/2007 | Operschall | F25B 39/04 62/474 |
| 7,213,412 | B2 * | 5/2007 | Kent | F25B 39/04 62/509 |
| 7,334,429 | B2 | 2/2008 | Forster et al. | |
| 7,836,725 | B2 * | 11/2010 | Lautner | F25B 39/04 62/506 |
| 7,938,173 | B2 | 5/2011 | Seno et al. | |
| 8,387,407 | B2 * | 3/2013 | Kaspar | F25B 39/04 62/317 |
| 8,950,213 | B2 | 2/2015 | Mitsuhashi et al. | |
| 8,959,948 | B2 * | 2/2015 | Armsden | F25B 43/006 62/474 |
| 2006/0185385 | A1 * | 8/2006 | Feldhaus | F25B 39/04 62/509 |
| 2010/0139313 | A1 | 6/2010 | Taras | |
| 2010/0186935 | A1 * | 7/2010 | Wand | F25B 39/04 165/173 |
| 2012/0167602 | A1 | 7/2012 | Taras et al. | |
| 2014/0366571 | A1 | 12/2014 | Gao et al. | |
| 2015/0021003 | A1 | 1/2015 | Cho et al. | |

* cited by examiner

MODULATOR FOR SUB-COOL CONDENSER

FIELD

The present disclosure relates to a modulator for a sub-cool condenser.

BACKGROUND

This section provides background information related to the present disclosure, which is not necessarily prior art.

While current vehicle heating, ventilation, and air conditioning (HVAC) condensers are suitable for their intended use, they are subject to improvement. For example, sub-cool condensers with a modulator sometimes include a tube extending through a center of the modulator. Liquid refrigerant entering the modulator is transported through the tube from a lower end of the modulator towards an upper end of the modulator, where the liquid refrigerant exits the modulator and is circulated through a sub-cool zone of the condenser. The tube is typically a plastic tube that must be installed within the modulator through a complex and time consuming installation operation. The present teachings provide for an improved sub-cool condenser modulator that eliminates the center tube, thereby making assembly of the modulator less time consuming, less complex, and more cost efficient. The present teachings provide for numerous additional advantages, as explained herein and as one skilled in the art will recognize.

SUMMARY

This section provides a general summary of the disclosure, and is not a comprehensive disclosure of its full scope or all of its features.

The present teachings provide for a modulator for a sub-cool condenser assembly, which includes a condenser. The modulator has a plurality of extruded tubes positioned to convey liquid refrigerant towards an outlet of the modulator.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
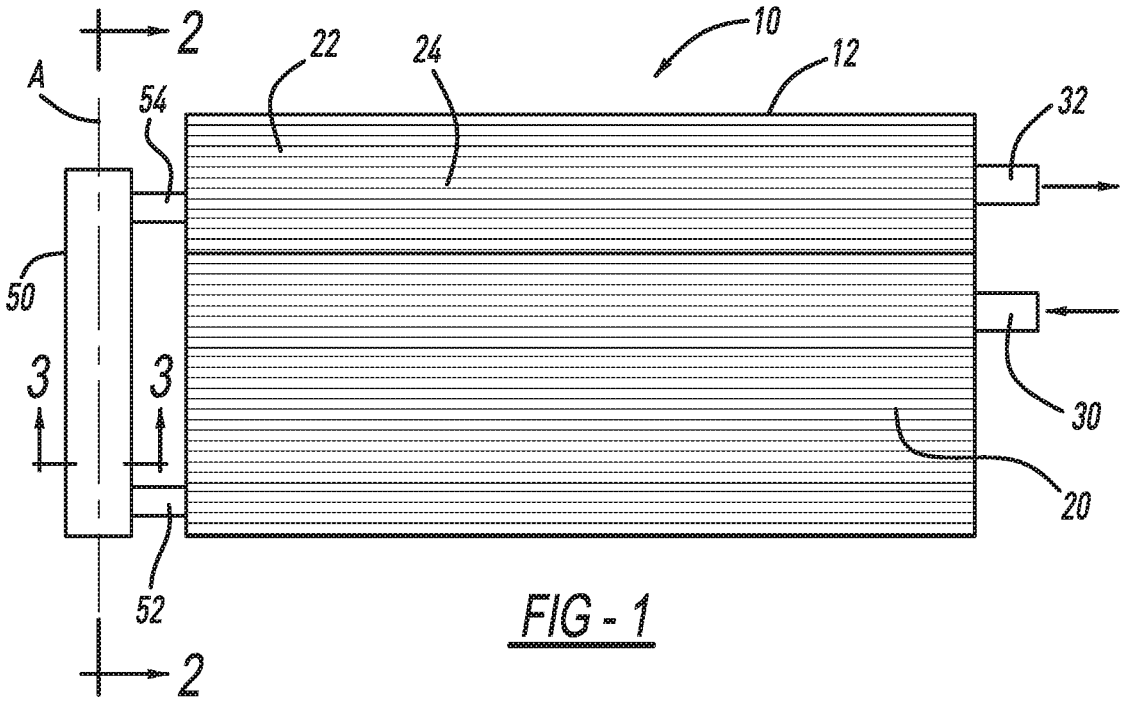
FIG. 1 illustrates a sub-cool condenser assembly in accordance with the present teachings.

FIG. 1 illustrates a sub-cool condenser assembly 10 in accordance with the present teachings. The sub-cool condenser assembly 10 can be used with any suitable heating, ventilation, and air conditioning (HVAC) system, such as a vehicle HVAC system. The assembly 10 generally includes a condenser 12 and a modular (also known as a receiver or dryer) 50.

The condenser 12 includes a plurality of condenser tubes 20, and a plurality of sub-cool tubes 22 present in sub-cool region 24. The condenser tubes 20 receive refrigerant from a compressor by way of inlet 30. The compressor compresses the refrigerant to a high temperature, high pressure gas. As the refrigerant flows through the condenser tubes 20, the high temperature, high pressure gas refrigerant condenses into a refrigerant that is part gas and part liquid, which flows to the modulator 50 through modulator inlet 52. At the modulator 50, the gas and liquid portions of the refrigerant are separated such that only liquid refrigerant flows out of the modulator 50 through modulator outlet 54 to the sub-cool tubes 22 of the sub-cool region 24. As the liquid refrigerant flows through the sub-cool tubes 22, the liquid refrigerant is cooled further, which results in lower HVAC system pressure and, consequently, a lower thermal load on the compressor, which advantageously increases fuel efficiency. The cooled refrigerant exits the sub-cool region 24 through an outlet 32. From the outlet 32 the refrigerant flows to an evaporator of the HVAC system.

Figure 2:
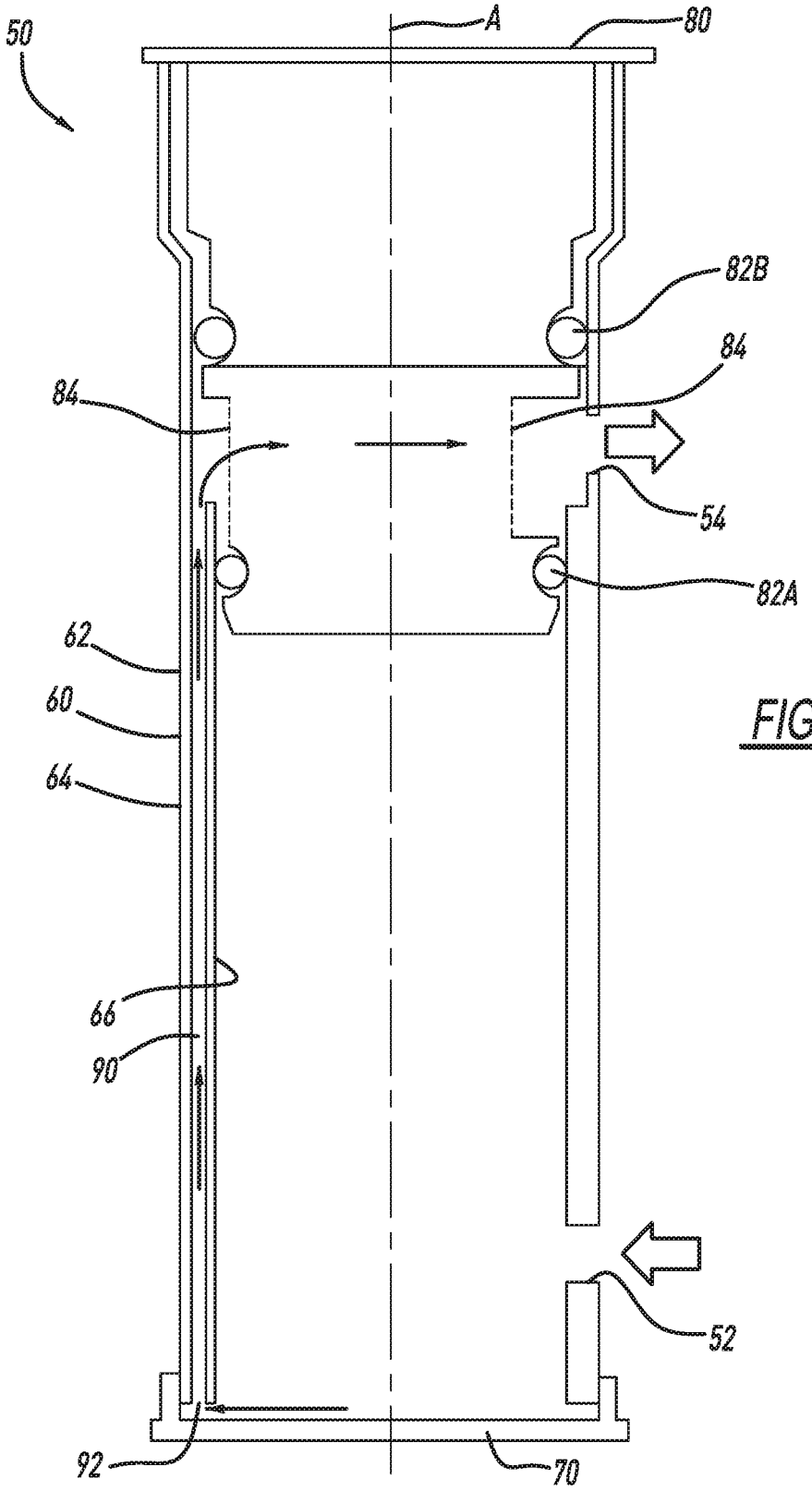
FIG. 2 is a cross-sectional view of a modulator of the sub-cool condenser assembly of FIG. 1 taken along line 2-2.

With reference to FIG. 2, the modulator 50 will now be described further. The modulator 50 includes a main body 60. The main body 60 can have any suitable shape, such as a tubular shape. The main body 60 can be formed in any suitable manner, such as by extrusion, and can be formed of any suitable material, such as aluminum. Thus the main body 60 can be an extruded aluminum tube having a sidewall 62. The sidewall 62 has an outer surface 64 and an inner surface 66, which is opposite to the outer surface 64. Longitudinal axis A extends through an axial center of the main body 60.

Coupled to a lower end of the main body 60 is a lower cap 70, which provides a base of the modulator 50. The lower cap 70 can be made of any suitable material, and can be coupled to the main body 60 in any suitable manner. At an upper end of the main body 60 is an upper cap 80. The upper cap 80 provides an upper surface of the modulator 50. The upper cap 80 can be made of any suitable material, and can be coupled to the main body 60 in any suitable manner. In the example illustrated, the upper cap 80 extends into the main body 60, and includes one or more seals 82A and 82B. The seals 82A and 82B provide seals against inner surface 66, and prevent the passage of liquid/gaseous refrigerant across the seals 82A and 82B. Between the seals 82A and 82B is a filter 84.

Figure 3:
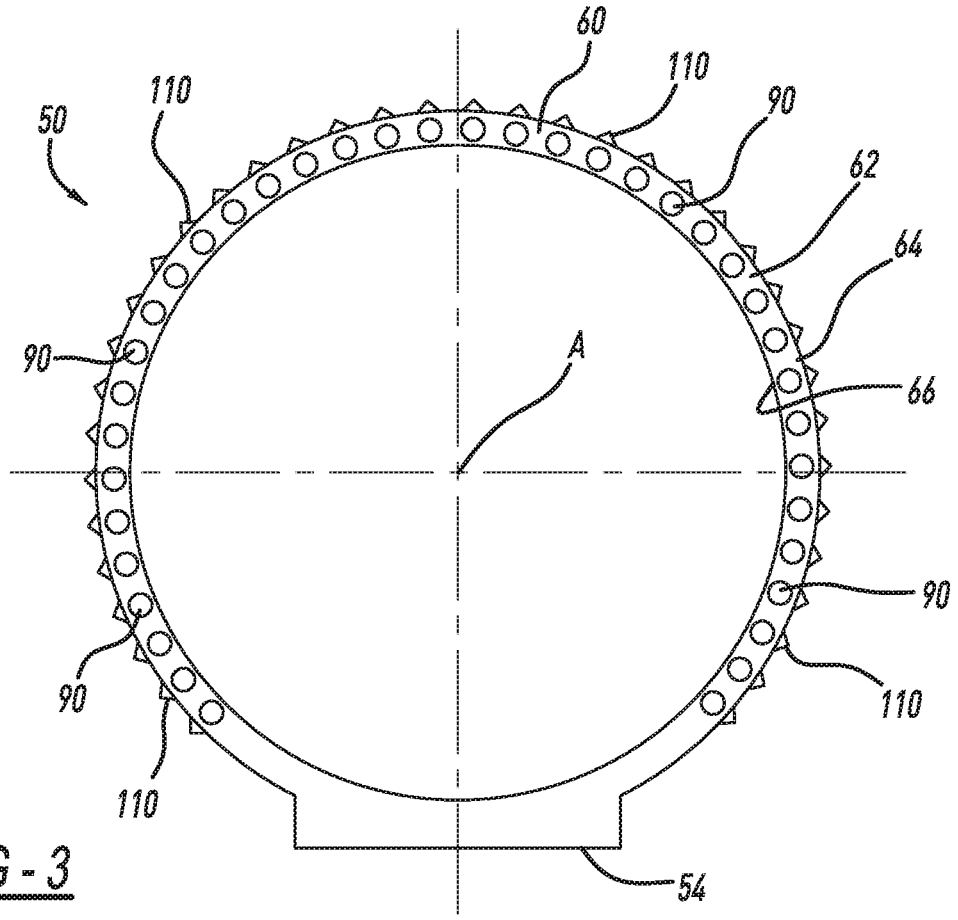
FIG. 3 is a cross-sectional view of the modulator taken along line 3-3 of FIG. 1.

The modulator 50 further includes a plurality of tubes or channels 90, which extend within the sidewall 62 generally parallel to the longitudinal axis A. As illustrated in FIG. 3, a plurality of tubes 90 can be included, and can be arranged about a substantial portion of, or an entirety of, the sidewall 62. The tubes 90 are extruded with the main body 60. In the example of FIGS. 2 and 3, the tubes 90 are arranged between the outer surface 64 and the inner surface 66 of the sidewall 62. The tubes 90 can be formed using any suitable extrusion process or technique.

As illustrated in FIG. 2, the lower cap 70 is arranged to define a gap 92 between the lower cap 70 and an opening of the tubes 90. Liquid/gaseous refrigerant enters the modulator 50 through the modulator inlet 52. The gaseous portion of the refrigerant rises within the main body 60 towards the upper cap 80. The seal 82A provides a gas-tight seal against the inner surface 66 to prevent gaseous refrigerant from flowing to the modulator outlet 54. The liquid portion of the refrigerant passes through the gap 92 and enters the tubes 90. The tubes 90 convey the liquid refrigerant past the seal 82A. The tubes 90 terminate prior to reaching the modulator outlet 54. The seals 82A and 82B prevent liquid refrigerant exiting the tubes 90 from flowing below the seal 82A and above the seal 82B. The filter 84 is generally aligned with the modulator outlet 54. Thus liquid refrigerant exiting the tubes 90 passes through the filter 84, and through the modulator outlet 54 to the sub-cool tubes 22. In this manner, the modulator 50 separates the gaseous refrigerant from the liquid refrigerant, and permits only the liquid refrigerant to exit the modulator 50 and flow to the sub-cool tubes 22 of the condenser 12.

As the liquid refrigerant flows through the tubes 90, heat of the liquid refrigerant is released to the environment surrounding the modulator 50. Thus the tubes 90 and the sidewall 62 act as a heat exchanger to further cool the liquid refrigerant. To facilitate cooling of the refrigerant as the refrigerant flows through the tubes 90, the sidewall 62 may include a plurality of heat dissipating elements 110 at the outer surface 64. The heat dissipating elements 110 can be extruded with the main body 60, or provided at the outer surface 64 in any suitable manner. The outside surface shape of each of the heat dissipating elements 110 is configured to maximize surface area and airflow contact, thereby maximizing heat transfer and cooling performance. Any suitable heat dissipating elements can be used, such as heat dissipating fins as illustrated.

Figure 4:
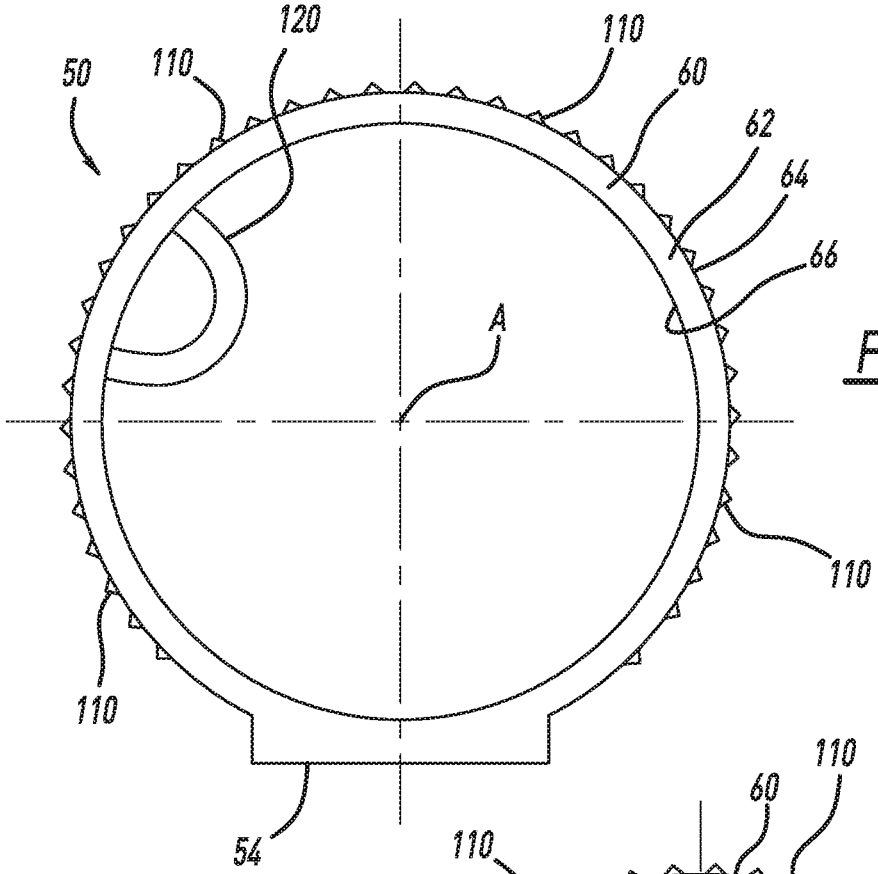
FIG. 4 is a cross-sectional view of another modulator in accordance with the present teachings.

With reference to FIG. 4, the tubes 90 may be replaced with one or more internal tubes 120 arranged at the inner surface 66 of the sidewall 62. The tube 120 can be extruded with the main body 60, or formed in any other suitable manner. The tube 120 functions in the same manner that the tubes 90 do. The tube 120 conveys liquid refrigerant entering the modulator 50 through the modulator inlet 52 to the modulator outlet 54 in order to further cool the liquid refrigerant and separate the liquid refrigerant from the gaseous refrigerant.

Figure 5:
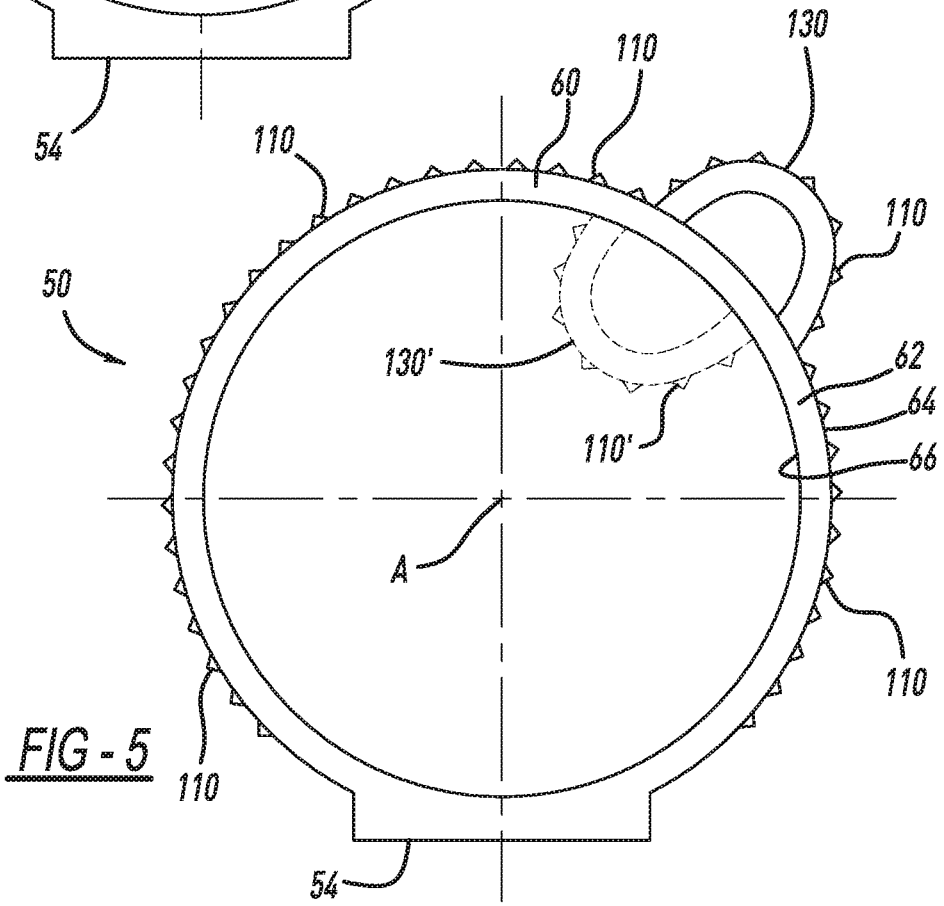
FIG. 5 is a cross-sectional view of an additional modulator in accordance with the present teachings.

With reference to FIG. 5, the main body 60 can be provided with one or more external tubes 130 in place of the tubes 90 and 120. The external tubes 130 advantageously increase the surface area exposed to the atmosphere about the modulator 50 in order to further facilitate heat transfer from the liquid refrigerant to the air about the modulator 50, thereby further cooling the liquid refrigerant. In some applications the external tubes 130 may be arranged as internal tubes 130' having heat dissipating elements 110' (see FIG. 5 in phantom). Some applications may include both the external tubes 130 and the internal tubes 130'.

The present teachings thus advantageously provide for a modulator 50 with a construction that is simplified and more efficient. For example, prior modulators often included a center tube arranged generally along the longitudinal axis A, which was a separate piece requiring time consuming and costly assembly. The tubes 90, 120, 130 of the present teachings can be extruded with the main body 60, thus simplifying the manufacturing and assembly processes, and providing greater cost efficiencies. The tubes 90, 120, 130 according to the present teachings also improve the operating efficiencies of the modulator 50. For example, liquid refrigerant traveling through the tubes 90, 120, 130 is further cooled because heat is released to the atmosphere surrounding the modulator 50 as the liquid refrigerant travels through the tubes 90, 120, 130 due to the position of the tubes 90, 120, 130 at the sidewall 62. By cooling the liquid refrigerant at the modulator 50, and prior to the liquid refrigerant being directed to the sub-cool tubes 22, fewer sub-cool tubes 22 are necessary to cool the liquid refrigerant to a desired temperature. Therefore, the number of sub-cool tubes 22 can be reduced, thereby advantageously reducing the size and cost of the condenser 12. The heat dissipating elements 110 further serve to cool the liquid refrigerant prior to the liquid refrigerant entering the sub-cool tubes 22, and can be included on an outer surface of external tube 130.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A modulator for a sub-cool condenser assembly, which includes a condenser, the modulator comprising:

an extruded main body including a sidewall having an outer surface and an inner surface, the inner surface defining a central chamber through which a longitudinal axis of the modulator extends;

a refrigerant inlet through which refrigerant from the condenser enters the modulator;

a refrigerant outlet through which refrigerant exits the modulator to a sub-cool region of the condenser;

a plurality of tubes extruded with the main body within the sidewall between the outer surface and the inner surface, the plurality of tubes are circular and spaced apart such that the plurality of tubes are present around more than half a circumference of the sidewall, the plurality of tubes extend from proximate to a base of the modulator to an area proximate to the refrigerant outlet to direct liquid refrigerant from the condenser towards the refrigerant outlet; and a plurality of heat dissipation fins at the outer surface of the extruded main body extending vertically parallel to the longitudinal axis of the modulator to facilitate heat exchange between refrigerant passing through the plurality of tubes and air around the extruded main body, wherein each one of the plurality of heat dissipation fins is arranged opposite to, and aligned with, a different one of the plurality of tubes.

2. The modulator of claim 1, wherein a gap is defined between the base and the plurality of tubes to allow liquid refrigerant to pass through the gap and enter the plurality of tubes.

3. The modulator of claim 1, further comprising a filter proximate to the refrigerant outlet to filter refrigerant prior to the refrigerant flowing through the refrigerant outlet.

4. The modulator of claim 1, wherein:

the extruded main body defines a main tube; and the base is defined by a lower cap coupled to the main tube.

5. The modulator of claim 1, wherein:

the extruded main body defines a main tube; and an upper surface of the extruded main body is defined by an upper cap coupled to the main tube.

6. The modulator of claim 5, further comprising a filter integral with the upper cap.

7. A modulator for a sub-cool condenser assembly including a condenser, the modulator comprising:

an extruded main body including a sidewall having an outer surface and an inner surface, the inner surface defining a central chamber through which a longitudinal axis of the modulator extends;

a plurality of extruded tubes extending within an interior of the sidewall of the modulator between the outer surface and the inner surface, the plurality of extruded tubes are circular and spaced apart such that the plurality of extruded tubes are present around more than half a circumference of the sidewall and are positioned to convey liquid refrigerant towards an outlet of the modulator; and a plurality of heat dissipation fins at the outer surface of the extruded main body extending vertically parallel to the longitudinal axis of the modulator to facilitate heat exchange between refrigerant passing through the plurality of extruded tubes and air around the extruded main body, wherein each one of the plurality of heat dissipation fins is arranged opposite to, and aligned with, a different one of the plurality of extruded tubes.

8. The modulator of claim 7, wherein the plurality of extruded tubes extend parallel to the longitudinal axis of the modulator.

9. The modulator of claim 7, further comprising a gap defined between the plurality of extruded tubes and a base of the modulator.

10. A sub-cool condenser assembly comprising:

a condenser including a plurality of condenser tubes and a sub-cool region; and a modulator coupled to the condenser, the modulator including:

an extruded main body including a sidewall having an outer surface and an inner surface, the inner surface defining a central chamber through which a longitudinal axis of the modulator extends; and a plurality of tubes extruded with the main body within the sidewall between the outer surface and the inner surface, the plurality of tubes are circular and spaced apart such that the plurality of tubes are present around more than half a circumference of the sidewall, the plurality of tubes are positioned to convey liquid refrigerant towards an outlet of the modulator, the outlet is in fluid communication with the sub-cool region of the condenser; and a plurality of heat dissipation fins at the outer surface of the extruded main body extending vertically parallel to the longitudinal axis of the modulator to facilitate heat exchange between refrigerant passing through the plurality of tubes and air around the extruded main body, wherein each one of the plurality of heat dissipation fins is arranged opposite to, and aligned with, a different one of the plurality of extruded tubes.

11. The sub-cool condenser assembly of claim 10, wherein a gap is defined between the base and the plurality of tubes to allow liquid refrigerant to enter the plurality of tubes.

* * * * *